US010923818B2

(12) United States Patent
Leung et al.

(10) Patent No.: US 10,923,818 B2
(45) Date of Patent: Feb. 16, 2021

(54) DUAL-FED DUAL-FREQUENCY HOLLOW DIELECTRIC ANTENNA

(71) Applicant: City University of Hong Kong, Kowloon (HK)

(72) Inventors: Kwok Wa Leung, Lowloon Tong (HK); Li Ying Feng, Teinjin (CN)

(73) Assignee: City University of Hong Kong, Kowloon (HK)

( * ) Notice: Subject to any disclaimer, the term of this patent is extended or adjusted under 35 U.S.C. 154(b) by 582 days.

(21) Appl. No.: 15/711,663

(22) Filed: Sep. 21, 2017

(65) Prior Publication Data

US 2019/0089056 A1 Mar. 21, 2019

(51) Int. Cl.
*H01Q 5/35* (2015.01)
*H01Q 1/38* (2006.01)
(Continued)

(52) U.S. Cl.
CPC ..... *H01Q 5/35* (2015.01); *H01Q 1/38* (2013.01); *H01Q 1/48* (2013.01); *H01Q 9/0485* (2013.01); *H01Q 13/18* (2013.01)

(58) Field of Classification Search
CPC ..... H01Q 9/0485; H01Q 5/35; H01Q 1/48; H01Q 1/38; H01Q 13/18
See application file for complete search history.

(56) References Cited

U.S. PATENT DOCUMENTS 5,453,754 A * 9/1995 Fray ..... H01Q 9/0485 343/700 MS
5,952,972 A * 9/1999 Ittipiboon ..... H01Q 9/0485 343/700 MS
(Continued)

FOREIGN PATENT DOCUMENTS

WO WO-2015192167 A1 * 12/2015 ..... H01Q 9/0485

OTHER PUBLICATIONS

Feng, L. Y. et al. "Dual-Frequency Folded-Parallel-Plate Antenna with Large Frequency Ratio," IEEE Trans. Antennas Propag., vol. 64, No. 1, pp. 340-345, Jan. 2016, 6 pages.
(Continued)

*Primary Examiner* — Dameon E Levi
*Assistant Examiner* — Jennifer F Hu
(74) *Attorney, Agent, or Firm* — Norton Rose Fulbright US LLP

(57) ABSTRACT

Systems and methods which provide a hollow dielectric block dual-fed dual-frequency antenna configuration, such as may be utilized for wireless device communication in multiple RF bands, multi-frequency radar applications, etc., are described. Embodiments of a hollow dielectric block dual-fed dual-frequency antenna provide operation with respect to widely separated frequencies, such as to operate at frequencies in both a millimeter-wave band and a microwave band. A hollow dielectric block dual-fed dual-frequency antenna of embodiments of the invention may be fabricated from a single hollow dielectric block configured to integrate a dielectric resonator antenna (DRA) and a Fabry-Perot resonator antenna (FPRA), wherein the hollow dielectric block may be configured to serve as the resonator for the DRA and the superstrate for the FPRA simultaneously. The resonant frequencies of the DRA and FPRA of a hollow dielectric block dual-fed dual-frequency antenna of embodiments can be determined independently.

20 Claims, 6 Drawing Sheets

(51) Int. Cl.

| | |
|---|---|
| ***H01Q 1/48*** | (2006.01) |
| ***H01Q 13/18*** | (2006.01) |
| ***H01Q 9/04*** | (2006.01) |

(56) References Cited

U.S. PATENT DOCUMENTS

| | | | | |
|---|---|---|---|---|
| 6,172,651 | B1 | 1/2001 | Du | |
| 6,355,573 | B1 | 3/2002 | Okumura et al. | |
| 6,392,605 | B2 | 5/2002 | Anterow | |
| 6,650,294 | B2 | 11/2003 | Ying et al. | |
| 6,995,715 | B2 | 2/2006 | Ying et al. | |
| 7,148,850 | B2 | 12/2006 | Puente Baliarda et al. | |
| 7,164,386 | B2 | 1/2007 | Baliarda et al. | |
| 7,202,822 | B2 | 4/2007 | Baliarda et al. | |
| 7,538,728 | B1 * | 5/2009 | Chang | H01Q 9/0485 343/700 MS |
| 7,554,490 | B2 | 6/2009 | Baliarda et al. | |
| 8,207,893 | B2 | 6/2012 | Baliarda et al. | |
| 8,212,726 | B2 | 7/2012 | Baliarda et al. | |
| 8,330,259 | B2 | 12/2012 | Soler Castany et al. | |
| 8,471,772 | B2 | 6/2013 | Puente Baliarda et al. | |
| 8,558,741 | B2 | 10/2013 | Baliarda et al. | |
| 8,610,627 | B2 | 12/2013 | Puente Baliarda et al. | |
| 8,803,749 | B2 | 8/2014 | Leung et al. | |
| 9,331,382 | B2 | 5/2016 | Baliarda et al. | |
| 10,361,487 | B2 * | 7/2019 | Rashidian | G03F 7/40 |
| 2003/0043075 | A1 * | 3/2003 | Bit-Babik | H01Q 9/0485 343/700 MS |
| 2008/0278378 | A1 * | 11/2008 | Chang | H01Q 9/0485 343/700 MS |
| 2010/0156754 | A1 * | 6/2010 | Kondou | H01Q 19/09 343/911 R |
| 2010/0220031 | A1 * | 9/2010 | Li | H01Q 9/04 343/860 |
| 2012/0306713 | A1 * | 12/2012 | Raj | H01Q 9/0485 343/785 |
| 2014/0327597 | A1 * | 11/2014 | Rashidian | H01Q 1/50 343/905 |
| 2015/0236428 | A1 * | 8/2015 | Caratelli | H01Q 5/45 343/755 |

OTHER PUBLICATIONS

Chen, H. M. et al. "A Compact Dual-Band Dielectric Resonator Antenna Using a Parasitic Slot," IEEE Antennas Wireless Propag. Lett., vol. 8, pp. 173-176, 2009, 4 pages.

Fang, X. S. et al. "Singly-Fed Dual-Band Circularly Polarized Dielectric Resonator Antenna," IEEE Antennas Wireless Propag. Lett., vol. 13, pp. 995-998, 2014, 4 pages.

Fang, X. S. et al. "Linear-/Circular-Polarization Designs of Dual-/Wide-Band Cylindrical Dielectric Resonator Antennas," IEEE Trans. Antennas Propag., vol. 60, No. 6, pp. 2662-2671, Jun. 2012, 10 pages.

Lu, K. et al. " a New Fabry-Perot Resonator Antenna Fed by an L-Probe," IEEE Trans. Antennas Propag., vol. 60, No. 3, pp. 1237-1244, Mar. 2012, 8 pages.

Konstantinidis, K. et al. "Multilayer Partially Reflective Surfaces for Broadband Fabry-Perot Cavity Antennas," IEEE Trans. Antennas Propag., vol. 62, No. 7, pp. 3474-3481, Jul. 2014, 8 pages.

Lu, Y. F. et al. "A Hybrid Approach for Finite-Size Fabry-Perot Antenna Design with Fast and Accurate Estimation on Directivity and Aperture Efficiency," IEEE Trans. Antennas Propag., vol. 61, No. 11, pp. 5395-5401, Nov. 2013, 7 pages.

Gardelli, R. et al. "Array Thinning by Using Antennas in a Fabry-Perot Cavity for Gain Enhancement," IEEE Trans. Antennas Propag., vol. 54, No. 7, pp. 1979-1990, Jul. 2006, 12 pages.

Guerin, N. et al. "A Metallic Fabry-Perot Directive Antenna," IEEE Trans. Antennas Propag., vol. 54, No. 1, pp. 220-224, Jan. 2006, 5 pages.

Pan, W. et al. "A Low-RCS and High Gain Partially Reflecting Surface Antenna," IEEE Trans. Antennas Propag., vol. 62, No. 2, pp. 945-949, Feb. 2014, 5 pages.

Jackson, D. R. et al. "Gain Enhancement Methods for Printed Circuit Antennas," IEEE Trans. Antennas Propag., vol. AP-33, No. 9, pp. 976-987, Sep. 1985, 12 pages.

Jackson, D. R. et al. "A Leaky-Wave Analysis of the High-Gain Printed Antenna Configuration," IEEE Trans. Antennas Propag., vol. 36, No. 7, pp. 905-910, Jul. 1988, 6 pages.

Al-Tarifi, M. A. et al. "The Puck Antenna: A Compact Design with Wideband, High-Gain Operation," IEEE Trans. Antennas Propag., vol. 63, No. 4, pp. 1868-1873, Apr. 2015, 6 pages.

Wong, K. L. "Analysis of a Hemispherical Dielectric Resonator Antenna with an Air Gap," IEEE Microw. Guided Wave Lett., vol. 3, No. 9, pp. 355-357, Oct. 1993, 3 pages.

Lim, E. H. et al. "Novel Application of the Hollow Dieletric Resonator Antenna as a Packaging Cover," IEEE Trans. Antennas Propag., vol. 54, No. 2, pp. 484-487, Feb. 2006, 4 pages.

Lim, E.H. et al. "The Compact Circularly-Polarized Hollow Rectangular Dielectric Resonator Antenna with an Underlaid Quadrature Coupler," IEEE Trans. Antennas Propag., vol. 59, No. 1, pp. 288-293, Jan. 2011, 6 pages.

Fang, X. S. et al. "Compact Differential Rectangular Dieletric Resonator Antenna," IEEE Antennas Wireless Propag. Lett., vol. 9, pp. 662-665, 2010, 4 pages.

Leung, K. W. et al. "Dual-Function Radiating Glass for Antennas and Light Covers—Part I: Omnidirectional Glass Dielectric Resonator Antennas," IEEE Trans. Antennas Propag., vol. 61, No. 2, pp. 578-586, Feb. 2013, 9 pages.

Leung, K. W. et al. "Dual-Function Radiating Glass for Antennas and Light-Covers—Part II: Dual-Band Glass Dielectric Resonator Antennas," IEEE Trans. Antennas Propag., vol. 61, No. 2, pp. 587-597, Feb. 2013, 11 pages.

Feng, L. Y. et al. "Dual-Fed Hollow Dielectric Antenna for Dual-Frequency Operation with Large Frequency Ratio" IEEE Trans. Antennas Propag., vol. 65, No. 6, pp. 3308-3313, Jun. 2017, 6 pages.

* cited by examiner

DUAL-FED DUAL-FREQUENCY HOLLOW DIELECTRIC ANTENNA

TECHNICAL FIELD

The invention relates generally to radio frequency (RF) signal communication and, more particularly, to dual-fed dual-frequency antenna configurations.

BACKGROUND OF THE INVENTION

The use of wireless communications has become so widespread as to nearly have become ubiquitous. Various devices, such as cellular phones, smart phones, personal digital assistants (PDAs), tablet devices, notebook computers, Internet of Things (IoT) devices, cameras, drones, etc. (collectively referred to herein as "wireless devices"), utilize wireless communication links for communicating voice, images, data, and/or the like.

The foregoing wireless devices are often adapted for communication in multiple radio frequency (RF) bands. For example, some such wireless devices may be adapted to utilize the communication networks of multiple service providers (e.g., a cellular network of mobile network operator A and a cellular network of mobile network operator B) for establishing wireless communication links, wherein network infrastructure of the different service providers may operate in different RF bands. Additionally or alternatively, some such wireless devices may be adapted for multiple modes (e.g., a cellular network of a mobile network operator and a wireless network of an Internet service provider) of wireless communications, wherein the different communication modes may operate in different RF bands.

Often some form of dual-frequency antenna system is provided in configuring wireless devices for communication in multiple RF bands. For example, a single radiator that is resonant in the different frequency bands (e.g., a broadband antenna) may be coupled (e.g., using a single RF signal interface, port, or "feed") to the RF front end circuitry of a wireless device for use in communication in multiple RF bands. Such antenna configurations, however, often suffer significant performance loss at either RF operating band due to compromises in the design for broadband or multiband operation. Moreover, further performance loss is often experienced due to the use of various circuit components (e.g., diplexers) used in accommodating the single feed antenna configuration. The general design of a dual-fed dual-frequency antenna is to use two horizontally or vertically arranged radiators, each operating in a single frequency band of the different frequency bands. Since different elements are used for the lower- and higher-frequency parts, large frequency ratios can be achieved easily. However, the total size and weight of such an antenna configuration can be considerable, particularly with respect to mobile wireless devices such as smartphones, PDAs, tablets, etc.

BRIEF SUMMARY OF THE INVENTION

The present invention is directed to systems and methods which provide a hollow dielectric block dual-fed dual-frequency antenna configuration, such as may be utilized for wireless device communication in multiple RF bands, multi-frequency radar applications, etc. Embodiments of a hollow dielectric block dual-fed dual-frequency antenna provide operation with respect to widely separated frequencies (i.e., provide a relatively large frequency ratio), such as to operate at frequencies in both a millimeter-wave band and a microwave band (e.g., operate at frequencies separated by an order of magnitude).

A hollow dielectric block dual-fed dual-frequency antenna of embodiments of the invention may be fabricated from a single hollow dielectric block configured to integrate a dielectric resonator antenna (DRA) and a Fabry-Perot resonator antenna (FPRA). For example, a hollow dielectric block may be configured to serve as the resonator for a microwave DRA and the superstrate for a millimeter-wave FPRA simultaneously. In providing the foregoing integrated DRA and FPRA configuration, the FPRA of a hollow dielectric block dual-fed dual-frequency antenna configuration may use the sidewall of the hollow region instead of spacers (e.g., foam or plastic cylinder) to support the dielectric superstrate of the FPRA, in contrast to a conventional FPRA configuration.

In operation, the hollow dielectric block of a hollow dielectric block dual-fed dual-frequency antenna may be excited by two ports simultaneously at two different frequencies. For example, a DRA of a hollow dielectric block dual-fed dual-frequency antenna may be excited by a vertical excitation strip on its sidewall, whereas a FPRA of the hollow dielectric block dual-fed dual-frequency antenna may be excited by a waveguide below the ground plane.

The resonant frequencies of the DRA and FPRA of a hollow dielectric block dual-fed dual-frequency antenna of embodiments of the invention can be determined independently. For example, changing the value of one or more design parameters (e.g., a dielectric height, cavity height, etc.) can shift the resonant frequency of the DRA substantially without affecting the resonant frequency of the FPRA. This aspect of a hollow dielectric block dual-fed dual-frequency antenna of embodiments may be utilized in obtaining a desired (e.g., large) frequency ratio with respect to the frequencies of the dual-frequency antenna configuration.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

A hollow dielectric block dual-fed dual-frequency antenna of embodiments of the invention provides a configuration in which a dielectric resonator antenna (DRA) and a Fabry-Perot resonator antenna (FPRA) are integrated into a single antenna element. For example, as illustrated in the schematic diagrams of FIGS. 1A-1C, a hollow dielectric block dual-fed dual-frequency antenna of embodiments of the invention may be fabricated from a single hollow dielectric block configured to serve as the resonator for a DRA and the superstrate for a FPRA. In accordance with some implementations of hollow dielectric block dual-fed dual-frequency antenna 100, the DRA thereof may be configured for operation with respect to one or more bands of microwave frequencies while the FPRA thereof may be configured for operation with respect to one or more bands of millimeter-wave frequencies.

Figure 1B:
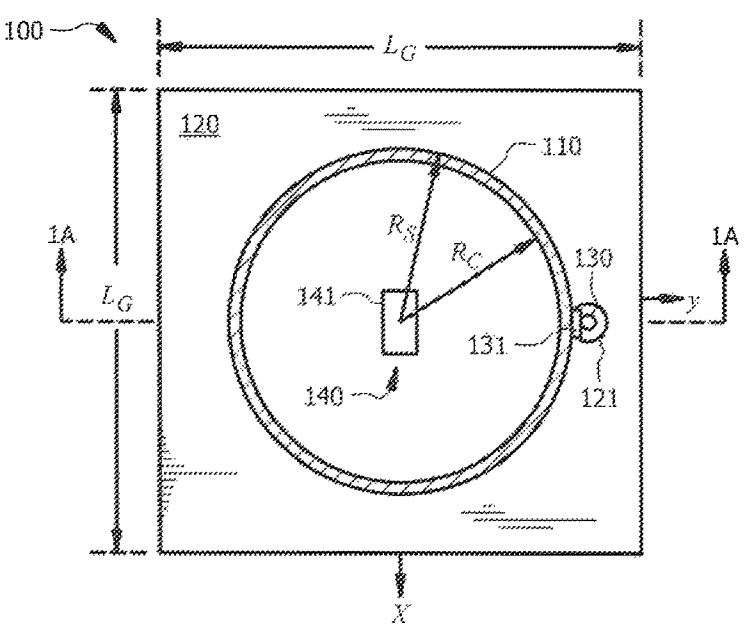
FIGS. 1A-1C show schematic diagrams of a hollow dielectric block dual-fed dual-frequency antenna of embodiments of the invention.
Figure 1C:
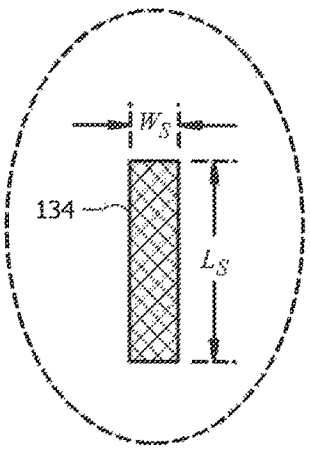
Figure 1A:
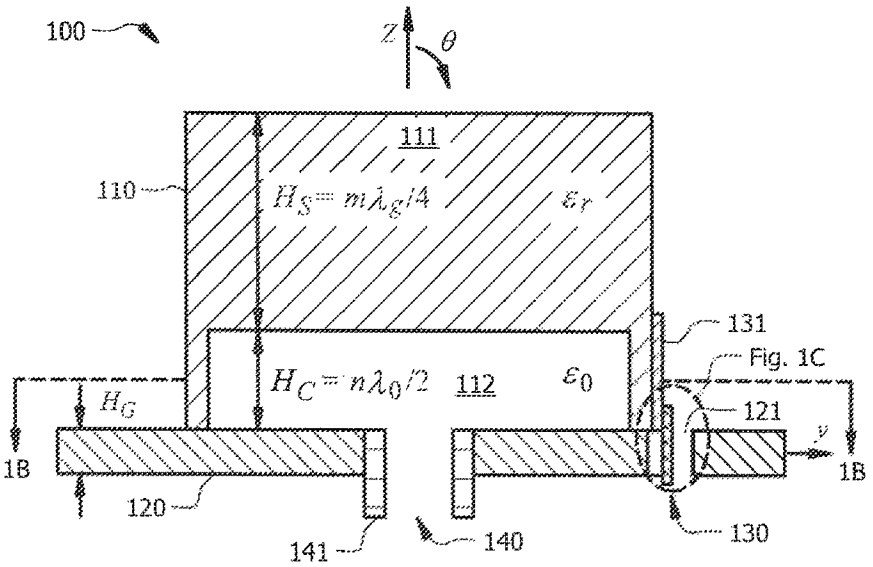

As shown in FIGS. 1A and 1B, hollow dielectric block dual-fed dual-frequency antenna 100 may comprise hollow dielectric block 110, disposed upon ground plane 120. Accordingly, the DRA of hollow dielectric block dual-fed dual-frequency antenna 100 of embodiments comprises a hollow cylindrical DRA formed from hollow dielectric block 110 disposed on ground plane 120. Hollow dielectric block 110 of the embodiment illustrated in FIGS. 1A and 1B has a radius of $R_S$, height of $H_S+H_C$, and dielectric constant of $\varepsilon_r$. Ground plane 120 (e.g., an aluminum ground plane) of the embodiment illustrated in FIGS. 1A and 1B has a side length of $L_G$ and thickness of $H_G$. A hollow cylindrical region, shown as cavity 112 in FIG. 1A, of radius $R_C$ and thickness $H_C$ is provided in dielectric 111 of hollow dielectric block 110 forming the DRA. Dielectric 111 of embodiments may comprise materials such as ceramic and glass. Cavity 112 of embodiments may comprise an air filled cavity or may comprise another material, such as Teflon and polyvinyl chloride (PVC), having a dielectric constant lower than that of dielectric 111.

In providing a dual-fed dual-frequency antenna configuration, hollow dielectric block dual-fed dual-frequency antenna 100 of the illustrated embodiment comprises DRA port 130 and FPRA port 140 providing separate RF signal interfaces for multiple frequencies simultaneously. DRA port 130 may comprise vertical excitation strip 131 disposed upon a sidewall of hollow dielectric block 110, such as may be sized to induce hybrid electric and magnetic (HEM) mode resonation of the DRA at desired millimeter-wave frequencies. For example, the DRA may be excited in its $HEM_{11\delta}$ mode by vertical excitation strip 131 of length $L_S$ and width $W_S$ as shown in FIG. 1C. The particular values for length $L_S$ and width $W_S$ utilized according to embodiments may be selected using a trial and error approach, such as may initially select a value for length $L_S$ of a quarter wavelength in air and an initial value for width $W_S$ of 1 or 2 mm for convenience of fabrication. As a specific example of an implementation of vertical excitation strip 131, the excitation strip may be cut from a piece of adhesive copper tape and adhered onto a sidewall of the hollow region of hollow dielectric block 110 and soldered to a connector pin of a DRA port connector (e.g., subminiature version A (SMA) connector). FPRA port 140 may comprise a waveguide disposed to interface with cavity 111 of hollow dielectric block 110, such as may comprise a waveguide configured for operation at desired microwave frequencies. For example, the FPRA may be fed by a WR-34 waveguide below the ground plane as shown in FIG. 1A.

Although a hollow region, such as cavity 111, can widen the bandwidth of a DRA at the cost of increasing its crosspolar field of radiation pattern, cavity 111 of hollow dielectric block dual-fed dual-frequency antenna 100 of embodiments herein is configured for integrating a FPRA mode, in addition to the DRA mode, with respect to hollow dielectric block dual-fed dual-frequency antenna 100. Accordingly, various attributes of dielectric 111 and/or cavity 112 (e.g., heights, widths, diameters, dielectric constants, etc.) of hollow dielectric block 110 are configured for providing an integrated FPRA implementation in combination with the DRA implementation according to embodiments of hollow dielectric block dual-fed dual-frequency antenna 100.

In accordance with the foregoing, to enhance broadside radiation of the FPRA, the heights of cavity 112 ($H_C$) and dielectric 111 ($H_S$) of hollow dielectric block 110 may be given by $$H_s = \frac{m\lambda_0}{4\sqrt{\varepsilon_r}} = \frac{m\lambda_g}{4} \tag{1}$$

$$H_c = \frac{n\lambda_0}{2} \tag{2}$$

where n, m are integers (m is odd), and $\lambda_g$ and $\lambda_0$ are resonant wavelengths in the dielectric and air (or a second dielectric forming cavity 112 having a different dielectric constant than dielectric 111), respectively. From equations (1) and (2), it can be appreciated that increasing m and n will increase the heights of the superstrate ($H_S$) and hollow region ($H_C$), respectively. Because m and n do not affect the resonant frequency of FPRA, they are typically set as m=n=1 in a conventional FPRA design for convenience. However, in configurations of hollow dielectric block dual-fed dual-frequency antenna 100 of embodiments herein, m and n are set (e.g., $m \neq n$ and/or $m \neq 1$) so as to enhance the gain of the FPRA and to provide a desired resonate frequency with respect to the DRA. For example, the gain of the FPRA can be enhanced by increasing the cross-sectional area of the superstrate, and thus m and n may be set to provide the heights of cavity 112 ($H_C$) and dielectric 111 ($H_S$) facilitating maximized cross-sectional area of hollow dielectric block 110. Moreover, the resonate frequency of the DRA can be selected by the heights of the cavity and dielectric portions of the dielectric resonator.

In an example of the foregoing, hollow dielectric block dual-fed dual-frequency antenna 100 may be configured to operate at frequencies in both a millimeter-wave band and a microwave band, such as to provide an implementation in which the DRA is operable with respect to a microwave frequency band centered at approximately 2.4 GHz and the FPRA is operable with respect to a millimeter-wave frequency band centered at approximately 24 GHz (e.g., the hollow dielectric block dual-fed dual-frequency antenna being operable at frequencies separated by an order of magnitude). In this exemplary embodiment, the dielectric resonator (hollow dielectric block 110 in the illustrated embodiment) may be fabricated from a dielectric bar with a cross-sectional area of 50×50 $mm^2$ and the radius of the dielectric resonator chosen as $R_S$=24 mm. The height of cavity 112 ($H_C$) and the height of dielectric 111 ($H_S$) may be designed using $\lambda_0$=12.50 mm at frequency f=24 GHz. Using m=n=1 gives $H_C$=6.25 mm and $H_S$=1.19 mm. However, with these heights the resonant frequency of the DRA is much higher than 2.4 GHz, and thus the size of the dielectric resonator (hollow dielectric block 110 in the illustrated embodiment) should be increased in order to decrease the resonant frequency to 2.4 GHz. Setting m=11 (corresponding to $H_S$=12.99 mm), for example, provides a resonant frequency of the DRA close to 2.4 GHz. In this case, the maximum gain of the FPRA is 24.25 GHz (as determined from simulation results), which is the upper frequency of 24-GHz ISM band (24-24.25 GHz). It should be appreciated that this deviation from 24 GHz can be expected because the theory assumes an infinite lateral structure but the structure when implemented is finite. To shift the maximum-gain frequency of the FPRA closer to 24.0 GHz, the values of $H_C$ and $H_S$ may be shifted to 6.30 mm and 13.10 mm, respectively, which gives $\lambda_0$=12.60 mm or f=23.80 GHz. This frequency is slightly lower than 24 GHz to compensate for the small (upward) frequency shift in the simulated result.

To demonstrate the dual-frequency operation of a hollow dielectric block dual-fed dual-frequency antenna implemented in accordance with the concepts herein, a hollow dielectric block dual-fed dual-frequency antenna configured for operation in the 2.4-GHz and 24-GHz ISM bands was designed using ANSYS HFSS and its prototype was fabricated. The dimensions of the hollow dielectric block dual-fed dual-frequency antenna of this exemplary implementation are given by $L_G$=100 mm, $H_G$=4 mm, $R_C$=23 mm, $R_S$=24 mm, $H_C$=6.30 mm, $H_S$=13.10 mm, $\varepsilon_r$=7, $\varepsilon_0$=1, n=1, m=11, $\lambda_0$=12.60 mm, $\lambda_g=\lambda_0/\sqrt{\varepsilon_r}$=4.76 mm, $L_S$=15.5 mm, and $W_S$=2 mm. Measurements made with respect to operation of the exemplary hollow dielectric block dual-fed dual-frequency antenna were divided into the microwave and millimeter-wave parts for analysis of the dual-frequency operation. For the microwave measurements, the S-parameters were measured with an Agilent E5071C network analyzer, whereas the radiation pattern, realized gain, and the antenna efficiency were measured by a Satimo StarLab system. For the millimeter-wave measurements, the S-parameters were measured using an E8361A network analyzer, and the radiation pattern and realized gain were measured with an NSI measurement system. Since the antenna efficiency cannot be directly measured by the NSI system, the antenna efficiency of the FPRA is calculated from the ratio between its measured realized gain and directivity.

Figure 2A:
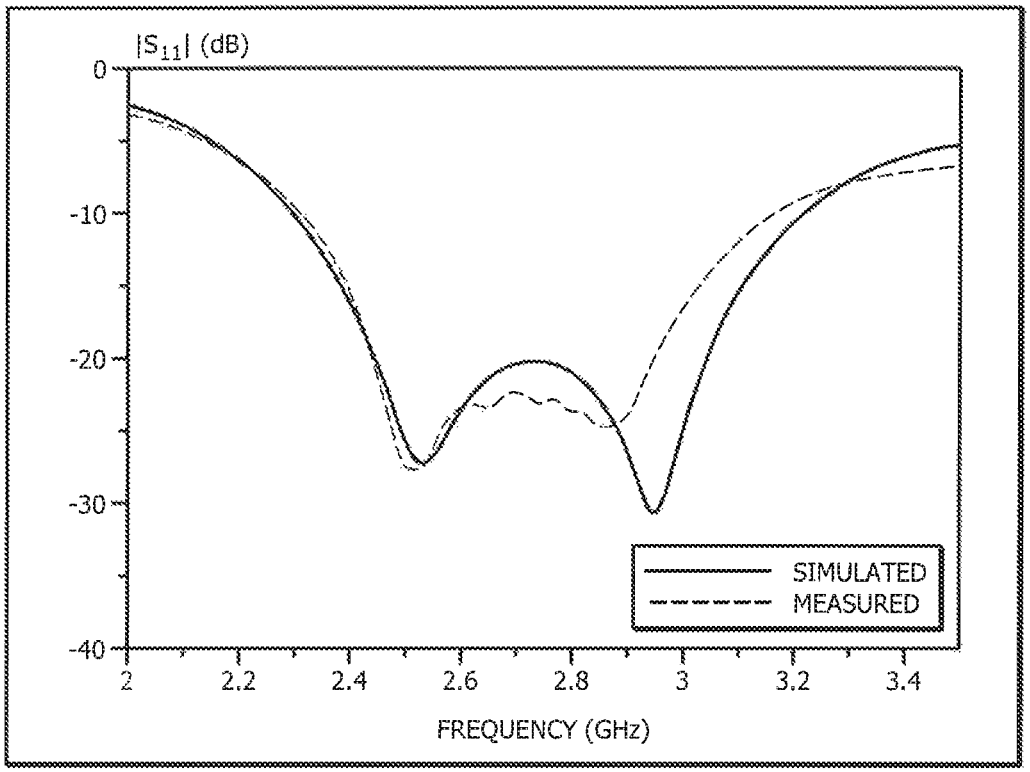
FIGS. 2A and 2B show measured and simulated reflection coefficients of an exemplary hollow dielectric block dual-fed dual-frequency antenna of embodiments of the invention.
Figure 2B:
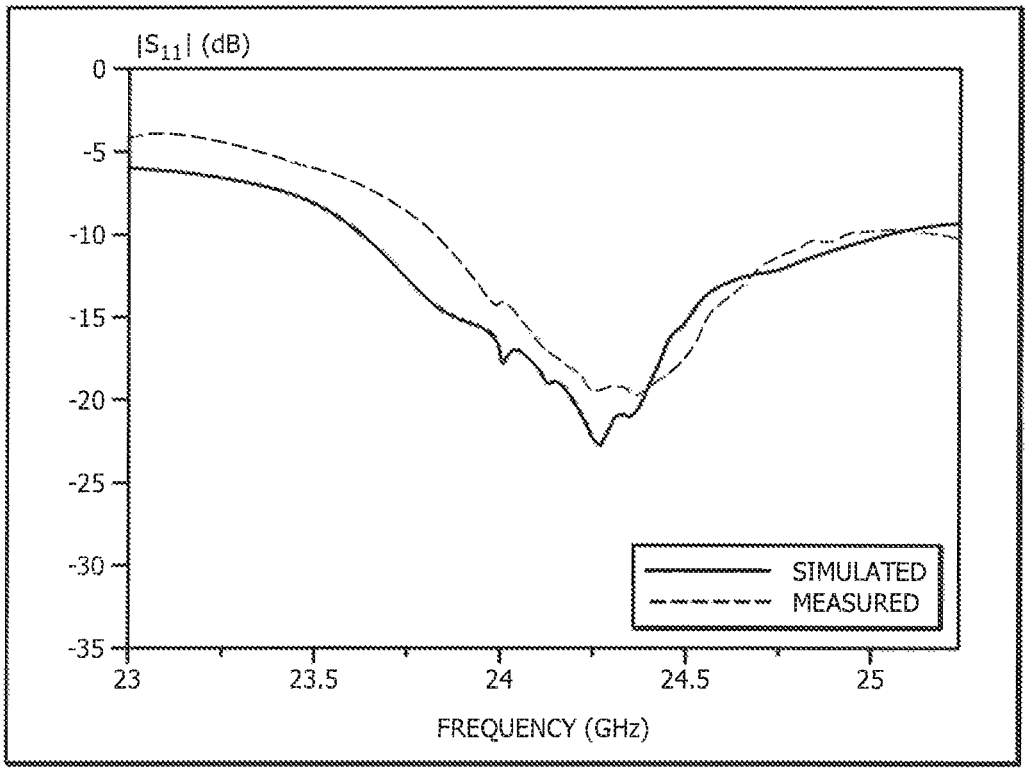

FIGS. 2A and 2B show the measured and simulated reflection coefficients of the exemplary hollow dielectric block dual-fed dual-frequency antenna, wherein reasonable agreement between the measured and simulated results is observed. In particular, FIG. 2A shows the measured and simulated impedance bandwidths ($|S_{11}|\leq 10$ dB) of the DRA of the exemplary hollow dielectric block dual-fed dual-frequency antenna, which are given by 30.77% (2.31-3.15 GHz) and 32.73% (2.30-3.20 GHz), respectively, with the discrepancy caused by experimental tolerances including the machining error of ±0.1 mm. Two local minima can be seen in the graph of FIG. 2A, illustrating a wide impedance bandwidth that covers both the 2.4-GHz ISM band (2.40-2.48 GHz) and the TDD-LTE band (2.496-2.690 GHz). FIG. 2B shows the measured and simulated impedance bandwidths of the FPRA are 4.67% (23.82-24.96 GHz) and 5.83% (23.64-25.06 GHz), respectively. As can be seen in the graph of FIG. 2B, the impedance bandwidths of the FPRA (both measured and simulated) cover the entire 24-GHz ISM band (24.0-24.25 GHz).

Figure 3A:
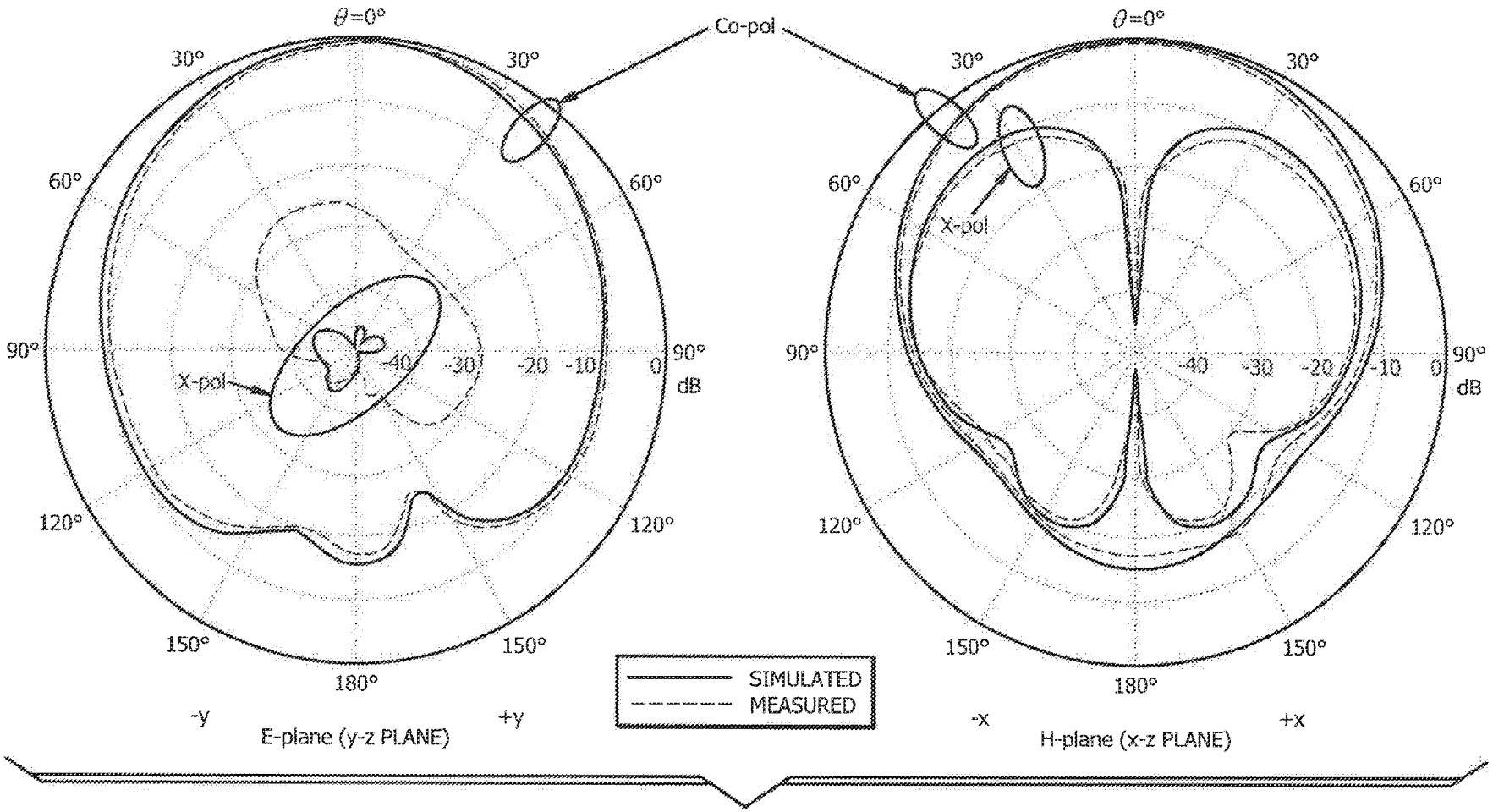
FIGS. 3A and 3B show measured and simulated radiation patterns of an exemplary hollow dielectric block dual-fed dual-frequency antenna of embodiments of the invention.
Figure 3B:
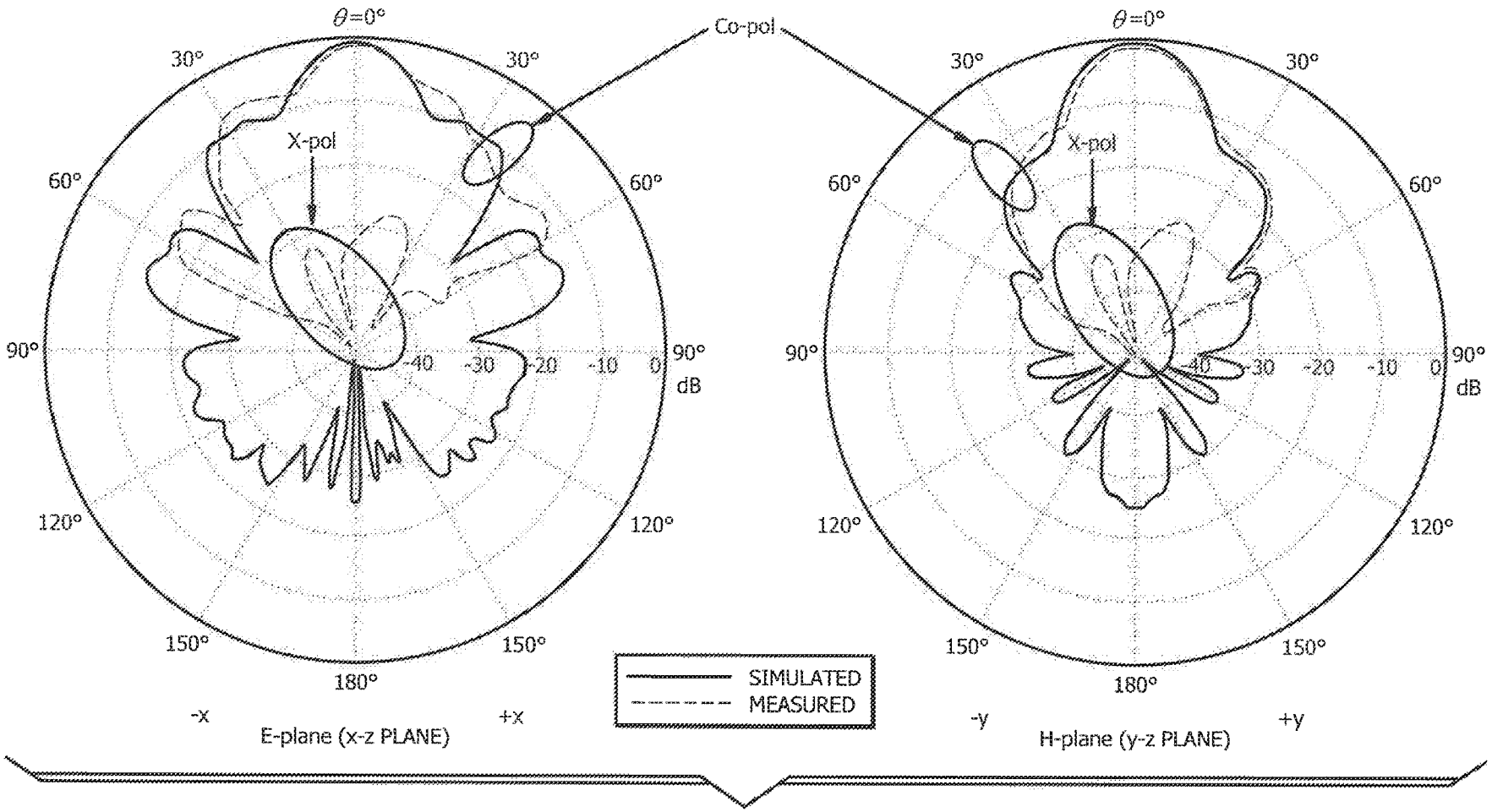

FIGS. 3A and 3B show the measured and simulated radiation patterns of the exemplary hollow dielectric block dual-fed dual-frequency antenna for the DRA at 2.45 GHz and the FPRA at 24.1 GHz. As can be seen from the plots of FIGS. 3A (DRA) and 3B (FPRA), well defined broadside radiation patterns are obtained for both the DRA and FPRA parts of the hollow dielectric block dual-fed dual-frequency antenna. It should be appreciated that, for each of the DRA and FPRA, the measured and simulated crosspolarized fields are weaker than their copolarized counterparts by at least 25 dB in the boresight direction (θ=0).

Figure 4A:
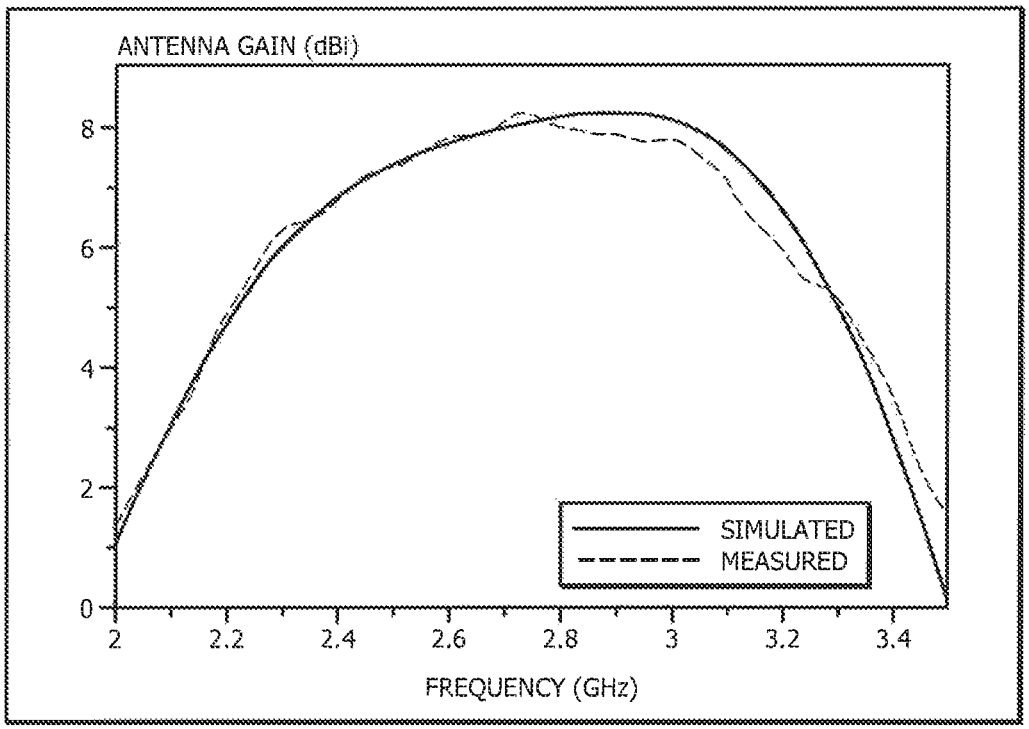
FIGS. 4A and 4B show measured and simulated realized gains in the boresight direction ($\theta=0°$) of an exemplary hollow dielectric block dual-fed dual-frequency antenna of embodiments of the invention.
Figure 4B:
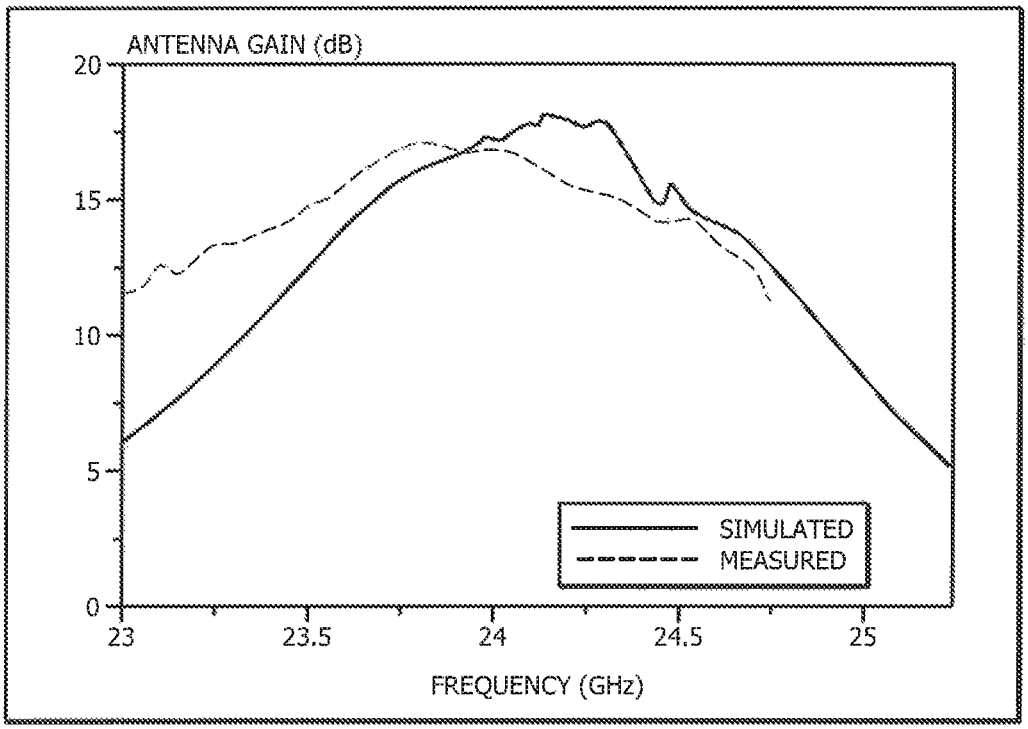
Figure 5A:
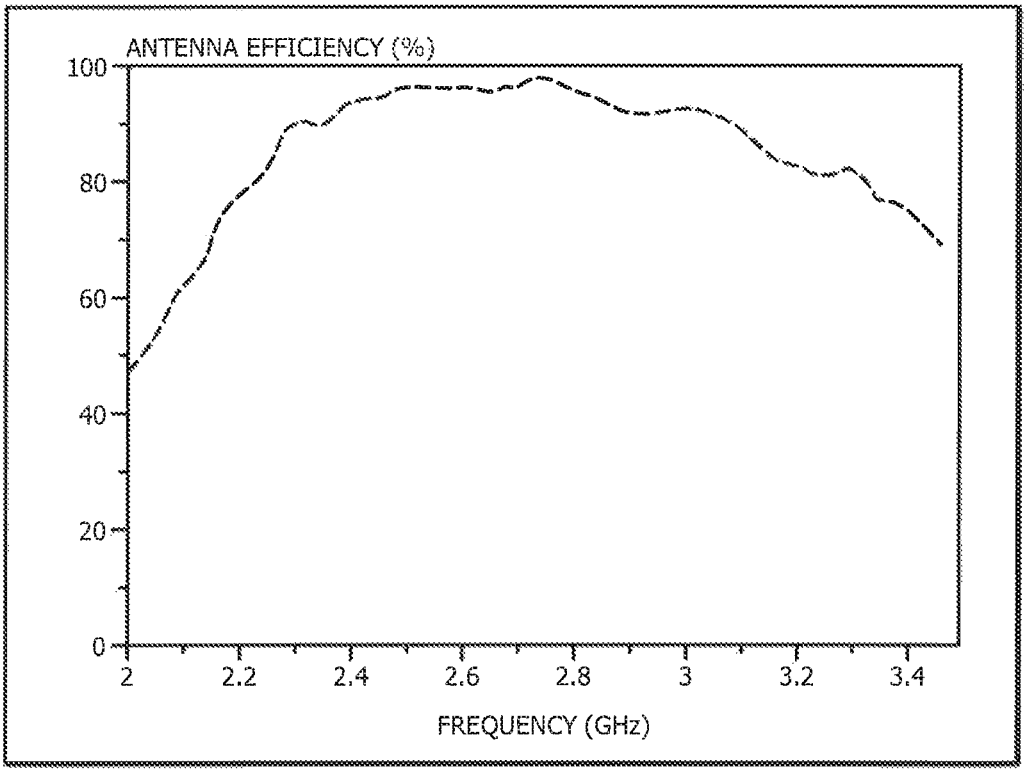
FIGS. 5A and 5B show measured antenna efficiency of an exemplary hollow dielectric block dual-fed dual-frequency antenna of embodiments of the invention.
Figure 5B:
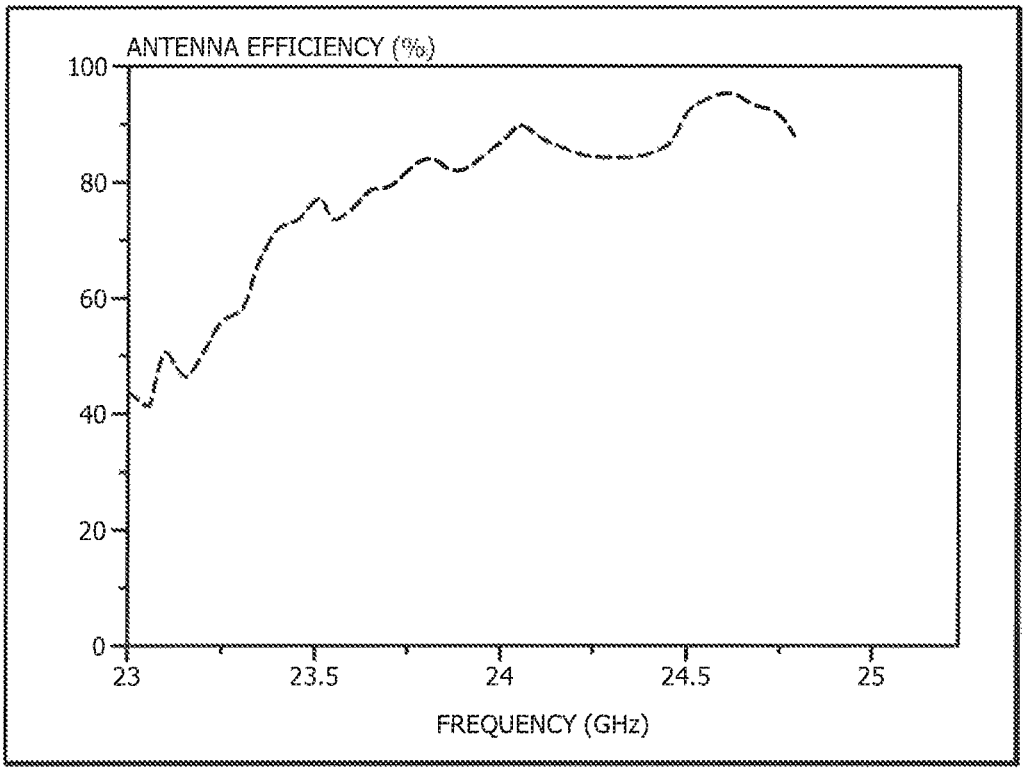

FIGS. 4A and 4B show the measured and simulated realized gains of the exemplary hollow dielectric block dual-fed dual-frequency antenna in the boresight direction (θ=0°) for the DRA (FIG. 4A) and FPRA (FIG. 4B) parts, wherein reasonable agreement between the measured and simulated results is observed. With reference to FIG. 5A, the ranges of the measured and simulated gains across their impedance passbands ($|S_{11}|\leq 10$ dB) are 6.34-8.21 dBi and 5.98-8.23 dBi, respectively, with variations of less than 2.5 dB for both cases. At 2.4 GHz, the measured and simulated gains are 6.81 dBi and 6.83 dBi, respectively, which are reasonable for DRA. FIG. 5B shows the peak gain of the FPRA, wherein it can be seen that the measured and simulated maximum gains are 17.2 dBi (at 23.8 GHz) and 18.2 dBi (at 24.15 GHz), respectively. The discrepancy is due to experimental imperfections including the machining error of ±0.1 mm. It should be appreciated that the measured antenna gain of the exemplary hollow dielectric block dual-fed dual-frequency antenna is almost 6 dB higher than that of the FPRA shown in L. Y. Feng and K. W. Leung, "Dual-frequency folded-parallel-plate antenna with large frequency ratio," *IEEE Trans. Antennas Propag.*, vol. 64, no. 1, pp. 304-245, January 2016, the disclosure of which is incorporated herein by reference.

FIGS. 5A and 5B show the measured antenna efficiency of the DRA (FIG. 5A) and FPRA (FIG. 5B) of the exemplary hollow dielectric block dual-fed dual-frequency antenna. With reference to FIG. 5A, the total efficiency of the DRA varies between 84.1% and 98.5% across the impedance passband. At 2.4 GHz, the total efficiency is given by 94.1%, showing that the hollow DRA is a highly efficient antenna. As may be seen from the antenna efficiency of the FPRA shown in FIG. 5B, the highest efficiency of 87.3% is obtained at 24 GHz. It should be appreciated that this efficiency is higher than the efficiency achieved using metallic plate implementation, such as described in L. Y. Feng and K. W. Leung, "Dual-frequency folded-parallel-plate antenna with large frequency ratio," *IEEE Trans. Antennas Propag.*, vol. 64, no. 1, pp. 304-245, January 2016, because there is no metallic loss in the FPRA of the exemplary hollow dielectric block dual-fed dual-frequency antenna.

From the forgoing it can be seen that embodiments of a hollow dielectric block dual-fed dual-frequency antenna fabricated from a single hollow dielectric block disposed upon a ground plane according to the concepts herein may provide a dual-frequency antenna having a relatively large frequency ratio with respect to the operating frequency bands. Moreover, a hollow dielectric block dual-fed dual-frequency antenna of embodiments of the invention allows for independently determining the resonant frequencies facilitating the operating frequency bands, such as by changing the value of one or more design parameters of the hollow dielectric block.

It should be appreciated that particular aspects of the exemplary embodiments described above are to aid in the understanding of the concepts herein and various differences may be provided with respect to implementations of hollow dielectric block dual-fed dual-frequency antennas. For example, although embodiments of a hollow dielectric block dual-fed dual-frequency antenna have been described herein with reference to a hollow dielectric block comprised of a dielectric and a cavity disposed therein, it should be appreciated that the concepts of the present invention are applicable to additional or alternative configurations. Accordingly, the cavity portion (e.g., cavity 112) of embodiments of a hollow dielectric block dual-fed dual-frequency antenna may comprise an area of dielectric material having a different dielectric constant than that of the dielectric portion (e.g., dielectric 111) of a hollow dielectric block (e.g., hollow dielectric block 110). As another example, although the ground plane (e.g., ground plane 120 of FIG. 1B) is shown as a square ground plane, various shapes and sizes of ground planes may be utilized according to embodiments of the invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a ground plane; and a dielectric block having a dielectric portion and a cavity portion disposed on the ground plane, wherein the dielectric block is configured to operate as a resonator for a dielectric resonator antenna (DRA) and a superstrate for a Fabry-Perot resonator antenna (FPRA).

2. The antenna system of claim 1, wherein the DRA comprises a microwave DRA, and wherein the FPRA comprises a millimeter-wave FPRA.

3. The antenna system of claim 1, further comprising a first radio frequency (RF) signal interface port and a second RF signal interface port, wherein the first RF signal interface port is configured to excite the dielectric block separately from the second RF signal interface port.

4. The antenna system of claim 3, wherein the first RF signal interface port comprises an excitation strip disposed to excite the DRA.

5. The antenna system of claim 4, wherein the excitation strip is disposed upon a sidewall of the dielectric block in correspondence with the cavity portion so that the sidewall provides support of the FPRA superstrate.

6. The antenna system of claim 5, wherein the second RF signal interface port comprises a waveguide disposed below the ground plane to excite the FPRA.

7. The antenna system of claim 1, wherein a height ($H_S$) of the dielectric portion of the dielectric block is given by $$H_s = \frac{m\lambda_0}{4\sqrt{\varepsilon_r}} = \frac{m\lambda_g}{4},$$

wherein m is an integer, $\lambda_g$ is a resonant wavelength in a dielectric of the dielectric portion of the dielectric block, and $\lambda_0$ is a resonant wavelength in a dielectric of the cavity portion the dielectric block, and wherein a value of m is selected to provide a desired resonant frequency of the DRA without affecting a desired resonant frequency of the FPRA.

8. A method comprising:

providing a dual-fed dual-frequency antenna having a ground plane and a dielectric block disposed on the ground plane, wherein the dielectric block includes a dielectric portion and a cavity portion, and wherein the dielectric block is configured to operate as a resonator for a dielectric resonator antenna (DRA) and a superstrate for a Fabry-Perot resonator antenna (FPRA);

using a first radio frequency (RF) signal interface port of the dual-fed dual-frequency antenna to excite the dielectric block with respect to a first resonate frequency; and using a second radio frequency (RF) signal interface port of the dual-fed dual-frequency antenna to excite the dielectric block with respect to a second resonate frequency, wherein the second RF signal interface port is configured to excite the dielectric block separately from the first RF signal interface port.

9. The method of claim 8, wherein the using the first RF signal interface port with respect to the first resonate frequency and the using the second RF signal interface port with respect to the second resonate frequency are simultaneous.

10. The method of claim 8, wherein the first resonate frequency and the second resonate frequency are separated by an order of magnitude.

11. The method of claim 8, wherein the first resonate frequency is a microwave frequency and the DRA is a microwave DRA, and wherein the second resonate frequency is a millimeter-wave frequency and the FPRA is a millimeter-wave FPRA.

12. The method of claim 8, wherein the providing the dual-fed dual-frequency antenna comprises:

selecting a height ($H_S$) of the dielectric portion of the dielectric block to provide a desired resonant frequency of the DRA without affecting a desired resonant frequency of the FPRA.

13. The method of claim 12, wherein the height ($H_S$) of the dielectric portion of the dielectric block is given by $$H_s = \frac{m\lambda_0}{4\sqrt{\varepsilon_r}} = \frac{m\lambda_g}{4},$$

wherein m is an integer, $\lambda_g$ is a resonant wavelength in a dielectric of the dielectric portion of the dielectric block, and $\lambda_0$ is a resonant wavelength in a dielectric of the cavity portion the dielectric block, and wherein the selecting the height ($H_S$) of the dielectric portion of the dielectric block comprises:

selecting a value of m to provide the desired resonant frequency of the DRA without affecting the desired resonant frequency of the FPRA.

14. The method of claim 8, wherein the first RF signal interface port comprises an excitation strip disposed to excite the DRA.

15. The method of claim 14, wherein the excitation strip is disposed upon a sidewall of the dielectric block in correspondence with the cavity portion.

16. The method of claim 14, wherein the second RF signal interface port comprises a waveguide disposed below the ground plane to excite the FPRA.

17. A dual-fed dual-frequency antenna comprising:

a ground plane;

a dielectric block having a dielectric portion and a cavity portion disposed on the ground plane, wherein the dielectric block is configured to operate as a resonator for a microwave dielectric resonator antenna (DRA) and a superstrate for a millimeter-wave Fabry-Perot resonator antenna (FPRA);

a DRA radio frequency (RF) signal interface port configured to excite the dielectric block with respect to a microwave resonate frequency; and a FPRA RF signal interface port configured to excite the dielectric block with respect to a millimeter-wave resonate frequency, wherein the FPRA RF signal interface port is configured to excite the dielectric block separately from the DRA RF signal interface port.

18. The dual-fed dual-frequency antenna of claim 17, wherein the DRA RF signal interface port comprises an excitation strip disposed upon a sidewall of the dielectric block in correspondence with the cavity portion so that the sidewall provides support of the FPRA superstrate.

19. The dual-fed dual-frequency antenna of claim 18, wherein the FPRA RF signal interface port comprises a waveguide disposed below the ground plane.

20. The dual-fed dual-frequency antenna of claim 17, wherein a height ($H_S$) of the dielectric portion of the dielectric block is given by $$H_s = \frac{m\lambda_0}{4\sqrt{\varepsilon_r}} = \frac{m\lambda_g}{4},$$

wherein m is an integer, $\lambda_g$ is a resonant wavelength in a dielectric of the dielectric portion of the dielectric block, and $\lambda_0$ is a resonant wavelength in a dielectric of the cavity portion the dielectric block, and wherein a value of m is selected to provide a desired resonant frequency of the microwave DRA without affecting a desired resonant frequency of the millimeter-wave FPRA.

* * * * *